United States Patent [19]

Nitzsche

[11] 3,985,352

[45] Oct. 12, 1976

[54] RIDER PROPELLED ROTATABLE RIDING DEVICE

[76] Inventor: Merlin J. Nitzsche, P.O. Box 96, Beemer, Nebr. 68716

[22] Filed: Oct. 15, 1975

[21] Appl. No.: 622,719

[52] U.S. Cl. ..... 272/33 R; 104/76; 272/44

[51] Int. Cl.[2] ..... A63G 1/20; A63G 1/34

[58] Field of Search ..... 272/33 R, 33 B, 43, 272/44, 45, 32, 46, 48, 50, 36, 39, 40, 42; 104/24, 58, 74, 79, 80, 164, 76

[56] References Cited

UNITED STATES PATENTS

| | | | |
|---|---|---|---|
| 496,759 | 5/1893 | Timby | 272/44 UX |
| 542,690 | 7/1895 | Steel | 272/44 |
| 604,998 | 5/1898 | Mangels | 272/33 R |
| 716,700 | 12/1902 | Fromm | 272/44 |
| 834,016 | 10/1906 | May | 272/44 UX |
| 858,624 | 7/1907 | Reckweg | 272/44 UX |

FOREIGN PATENTS OR APPLICATIONS

| | | | |
|---|---|---|---|
| 629,035 | 7/1927 | France | 272/44 |

*Primary Examiner*—Richard C. Pinkham
*Assistant Examiner*—Arnold W. Kramer
*Attorney, Agent, or Firm*—Larson, Taylor & Hinds

[57] ABSTRACT

An amusement device comprises a rider propelled rotatable riding device, such as a roundabout or merry-go-round, on which one or more riders propel themselves in a circular path. The device has two concentric vertically undulating tracks of different radii, such that they constitute inner and outer tracks. The undulations preferably are 180° out of phase on the respective tracks. A rotatable structure is mounted for rotation concentrically with respect to the track, and carries a pair of freely rotatable wheels generally vertically movable for rolling along the undulating surfaces of the respective tracks. The wheels are coupled with rider controlled linkage means permitting a rider to selectively intermittently urge either wheel against its undulating track surface with increased force relative to the other wheel, whereby the supporting structure can be rotatably driven by selectively and alternately urging either wheel against a downhill portion of its undulating track relative to the force urging the other wheel against a non-downhill portion of the other undulating track. Preferably the linkage includes a seat which is rockably mounted, so that the propelling force can be effected by a rocking movement of the rider on the seat.

12 Claims, 4 Drawing Figures

FIG. 1
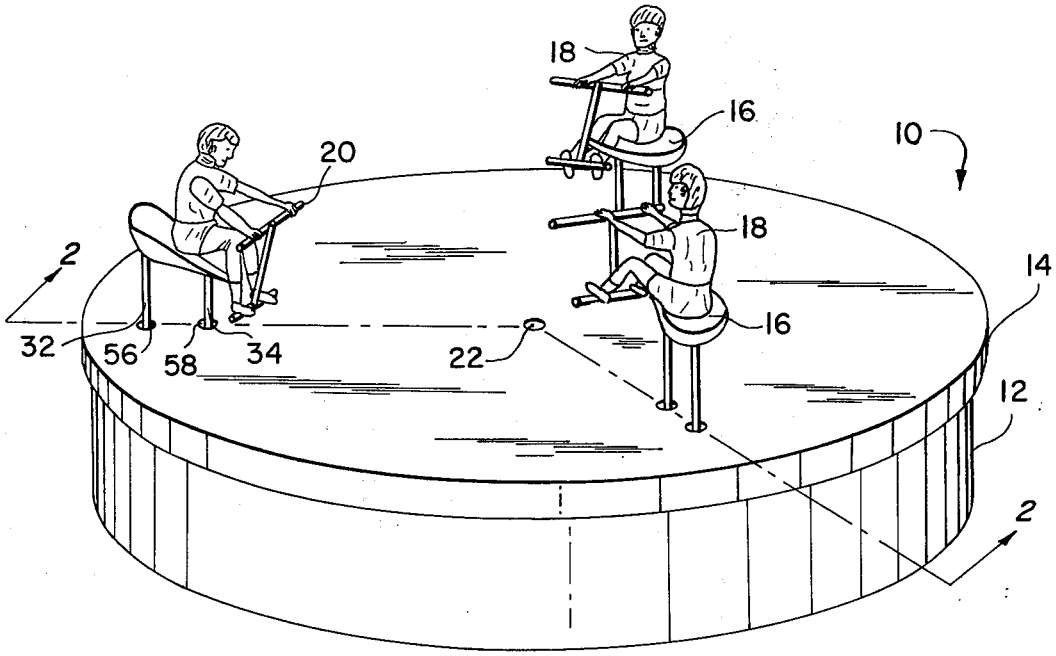
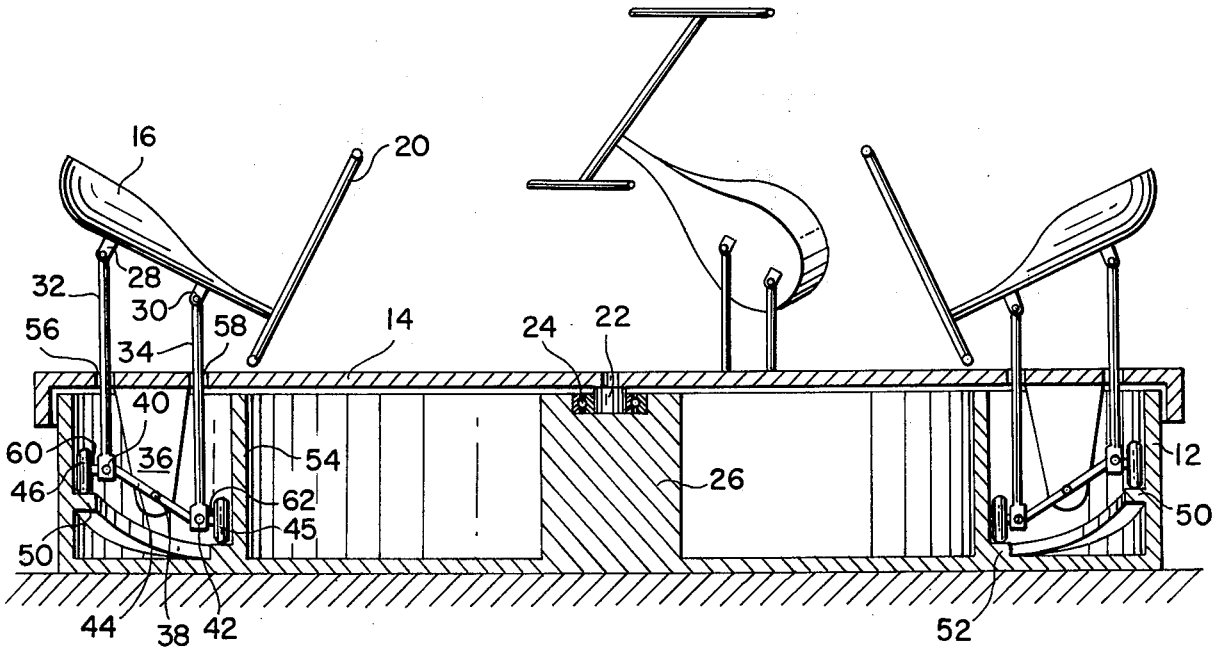
FIG. 2

RIDER PROPELLED ROTATABLE RIDING DEVICE

FIELD OF THE INVENTION

This invention relates to amusement devices, and more particularly to such devices known as rider-propelled roundabouts or merry-go-rounds, wherein a rider's weight-shifting motion or the like is translated into rotational motion of the device.

BACKGROUND OF THE INVENTION

Rider propelled amusement devices of the general type to which the invention relates are well known in the art. In many such devices, a rider's weight shifting motions or push-pull motions are translated into rotation by a series of linkages connected to a center post. Alternative approaches are described in U.S. Pat. No. 2,447,203 (O'Toole) of Aug. 17, 1948, U.S. Pat. No. 3,235,251 (DeShano) of Feb. 15, 1966, and U.S. Pat. No. 3,642,275 (Ellico) of Feb. 15, 1972. In these devices a rider sits, stands, or otherwise supports himself on a rotatably mounted structure above an undulating circular track. A wheel assembly is carried by the rotatable structure so as to be rollable along the undulating track. By applying downward force to the wheel assembly against appropriate portions of the undulating track, the rider causes the wheel to roll up and down the undulating track, thus translating this downward force into rotational motion of the rotatable structure. The downward force can be generated by rocking motion of the rider, through direct application of weight intermittently to the wheel assembly by a foot, through manipulation of a handle, etc. Thereafter it is basically a matter of hanging on for dear life and waiting for the roller assembly to pass on to another descending portion of the undulating track so that a further propelling force can be imparted to the rotatable structure through the wheel assembly. Since a rider cannot generate propelling force when the wheel assembly is passing through an ascending portion of the track, he generally must either rely on his momentum to carry him past this ascending portion, or have another rider in a complimentary position to provide a downward force during the first rider's coasting phase. In different arrangements, the motion of the rider may be pure rotation in a single phase, or this may be coupled with undulating or rocking movement of the rider support structure.

Basically, it is an object of the present invention to provide a rider propelled rotatable riding device which is believed to be a general improvement over earlier such devices, and one which permits a rider to apply weight-shifting force more frequently to propel his rotation, and indeed to permit him to apply this force almost continuously.

In keeping with my invention, the device comprises two similar, concentrically mounted, circular, vertically undulating tracks formed with peaks and valleys, the tracks being of different radii such that they are spaced from each other as inner and outer tracks. A rotatable rider supporting structure is mounted for rotation concentrically with respect to the tracks, and has coupled thereto a pair of freely rotatable wheels, generally vertically movable, for rolling along the undulating surfaces of respective ones of the tracks. The tracks and wheels are relatively disposed such that each wheel relative to its undulating track is out of phase with the other wheel relative to its undulating track, and preferably this is accomplished by having the undulating tracks substantially 180° out of phase with each other. Rider controlled linkage means are provided for selectively intermittently urging either wheel against its undulating track surface with increased force relative to the other wheel, such that the supporting structure can be rotatably driven by selectively and alternately urging either wheel against a downhill portion of its undulating track relative to the force urging the other wheel against a non-downhill portion of the other undulating track. Preferably the wheels are coupled together by a pivotal link or shaft which is oriented in a generally radial plane, pivotally coupled at its midpoint to the rider support structure for pivotal movement vertically in the radial plane, and coupled to the wheels at its radially inner and outer ends, whereby the wheels are pivotally coupled together for substantially equal but opposite movement in a vertical radial plane as they roll along the vertically undulating tracks. I prefer that the pivotal shaft or link be pivotally coupled beneath the support structure, and that actuating links are coupled to this shaft on opposite sides of its pivot axis and extend upwardly through the support structure such that their upper ends are exposed for rider manipulation vertically. Advantageously, a rider support seat is coupled to the upper ends of the actuating links such that a rider seated thereon can rock radially back and forth and shift his weight from one actuating link to the other so as to alternately relatively urge either link downwardly and decrease the relative downward force on the other link. Typically a plurality of such seats with their associated linkages and wheels will be provided at equally spaced intervals about the periphery of the rotatable support structure. The assembly of the lower pivotal shaft or link, the upright actuating links, and the rider seat may resemble and function as an adjustable or variable parallelogram, and additional cross-links may be coupled to the upright links and to the rider support structure for increased strength and stability. The wheels themselves may be mounted rotatably on the lower pivotal shaft or link, in which case they will lean inwardly and outwardly with the pivotal movement of the pivotal shaft, or they may be rotatably mounted on stub shafts carried by the lower portions of the upright actuating links, in which case they will remain substantially vertical, but will vary slightly in horizontal distance from each other. The device can be easily fabricated with sufficient clearance or play as to accommodate either arrangement.

Other features and advantages of the invention will be set forth in or apparent from the ensuing description of a preferred embodiment of the invention, taken with reference to the accompanying drawings.

BRIEF DESCRIPTION OF THE DRAWINGS

FIG. 1 is a perspective view of an exemplary preferred assembly, not to scale, having three riders and three seats.

FIG. 2 is a side elevation view in section taken along lines 2—2 in FIG. 1.

DESCRIPTION OF AN EXEMPLARY PREFERRED EMBODIMENT

Figure 3:
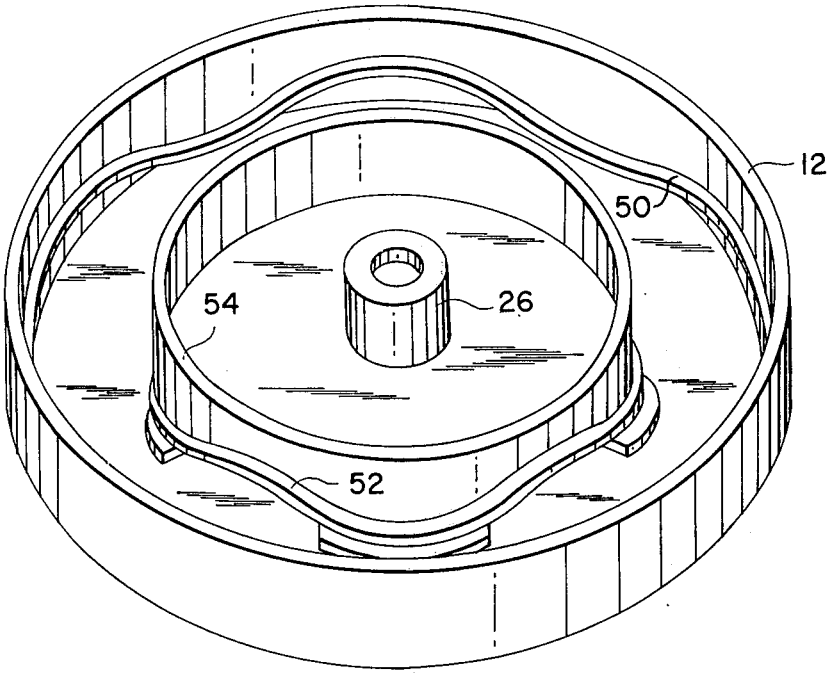
FIG. 3 is a perspective view of the base of the invention with the rotating platform or support structure removed, and illustrating the concentric track arrangement.

Referring to FIG. 1, a rider propelled roundabout or merry-go-round is generally denoted 10. This comprises a platform 14 rotatably mounted on a fixed base 12 so as to rotate about a center post 22. Platform 14 supports a number of seats 16, each seat facing in general radial alignment with the center of the platform 14. While FIG. 1 illustrates a preferred arrangement with three such seats, any number, including one, is acceptable. Each seat has connected to its front, that is, the inner end of seat 16 pointing toward center post 22, a handle bar and foot rest assembly 20. A rider 18 sits in a seat 16 and places his hands and feet on the assembly 20 for support and safety, as well as leverage.

Figure 4:
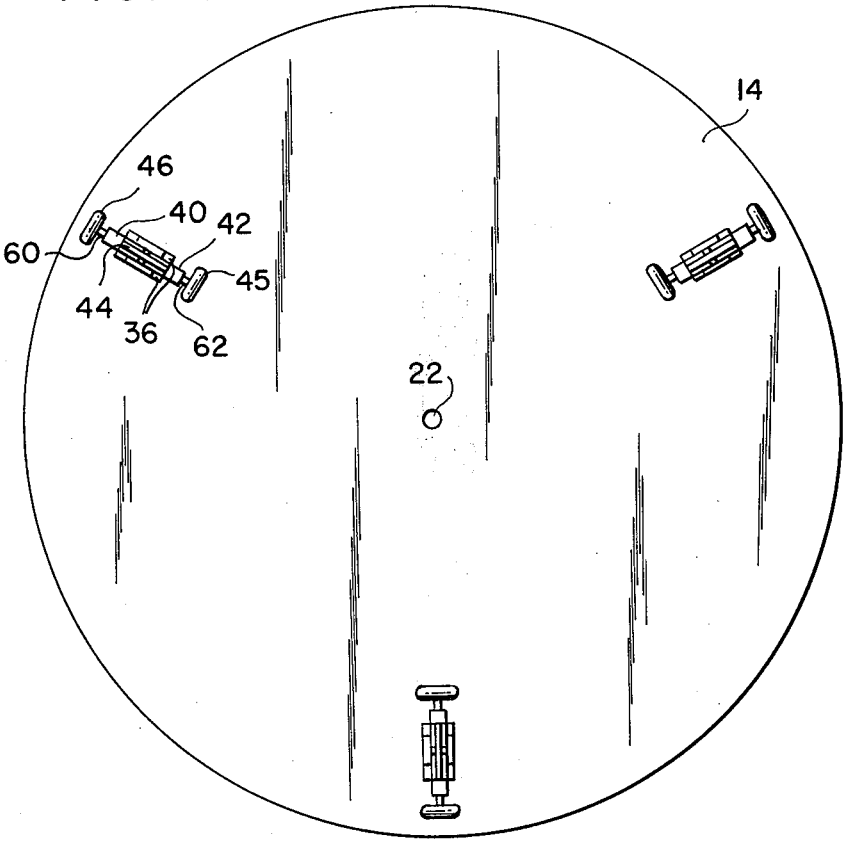
FIG. 4 is a bottom plan view of a rotating platform assembly of the type shown in FIG. 1.

FIGS. 2–4 illustrate the drive and support apparatus of the exemplary embodiment. Each seat 16 has mounting brackets 28 and 30 affixed beneath it, these brackets being pivotally coupled to two actuating links or connecting rods 32 and 34 at their upper ends. Rods 32 and 34 extend through openings 56 and 58 in platform 14, and are fixed at their lower ends to axle blocks or shaft blocks 40 and 42. Blocks 40 and 42 are coupled together by a pivot rod or shaft 44, which is pivotally coupled at its midpoint 38 to a support member 36 extending downwardly from the underside of platform 14. An outer wheel 46 is rotatably mounted on an outer stub shaft 60 carried by shaft block 40, and an inner wheel 45 is correspondingly arranged on inner stub shaft 62 carried by shaft block 42. Pivot shaft 44 is pivotably coupled at its ends to shaft blocks 40 and 42. Hence, the inner and outer wheels move generally in equal but opposite directions under the control of the assembly of linkages described.

As shown in FIGS. 2 and 3, base 12 has two concentric vertically undulating tracks. Outer track 50 runs along the inner surface of base wall 12, while inner track 52 runs along the outer surface of an inner base wall 54. Tracks 50 and 52 can be of varying heights and steepness depending upon the rotational speed to be obtained, the amount of rocking motion desired, weight of riders relative to the size and weight of the rotatable structure, etc. Preferably the peaks and valleys of the two tracks are approximately 180° out of phase with respect to each other, such that when one track is rising, the radially opposite portion of the other track is falling, and vice versa. Preferably they should be similarly configured, and differ basically in diameter. They should be sufficiently wide as to provide a measure of play or clearance for limited lateral movement of the wheels, or inclination of the wheels. In keeping with this, the wheels themselves preferably should have rounded or curved outer surfaces, especially if the linkage is so constructed that the wheels incline laterally upon pivoting of lower pivot shafts 44. The number of peaks and valleys can be set as desired, and the transitions of the undulations should be relatively smooth and gradual.

A support post 26 is located at the center of base 12 and carries a bearing assembly schematically indicated at 24, which may constitute a conventional roller bearing, thrust bearing, etc. However, since a substantial degree of support for platform 14 is provided by the wheels and their associated linkages coupled to the platform, the vertical thrust supporting capability of the bearing need not be large. In any event, platform 14 is relatively freely rotatable with respect to base 12, the inner and outer wheels following an undulating path in keeping with their respective tracks during the rotation, and the seats 16 rocking back and forth in keeping with the vertical displacements of their wheels and associated links 32 and 34.

The operation of the device will be readily apparent from the foregoing description and illustrations. In essence, a rider 18 sits in seat 16 and places his hands and feet on the handle bar and foot rest assembly 20. By shifting his weight appropriately to increase the downward force on the wheel which is on a descending portion of its track, he causes platform 14 to begin rotating as the wheel rolls down this descending portion. As this wheel moves downwardly into a valley of its track, the other wheel will have moved up on a peak of its track and onto a descending portion of its track, such that the rider 18 now shifts his weight in opposite direction to apply further propelling force. By repeating this weight shifting, the rider can increase his rotational speed and momentum, and thus make it easier to shift his weight by rocking back and forth.

The openings 56 and 58 in platform 14 should be sized large enough radially to provide clearance in a radial direction to permit links 32 and 34 to move slightly toward and away from each other during operation, as inherently occurs to a limited extend because of the parallelogram nature of the overall linkage. It will also be appreciated that an additional linkage similar to pivotal linkage 44 could be pivotally coupled to links 32 and 34 and support 36 so as to increase the vertical support for the seats.

While I prefer that the two wheels be generally radially aligned and that the inner and outer tracks be out of phase as previously stated, it will be appreciated that the important consideration is that each wheel relative to its track be out of phase with the other wheel relative to its track. Therefore, it is entirely feasible to arrange the wheels so that they are circumferentially offset, in which event the out of phase orientations of the two tracks could be correspondingly reduced. In fact, through suitable linkages, the wheels could be circumferentially offset sufficiently to permit reorientation of the seat such that the rider would face in the direction of rotation and rock back and forth in the direction of rotation rather than radially, as presently illustrated. The particular relative locations and orientations of the wheels, although preferred, should be considered as exemplary of the invention, and it will be realized by those skilled in the art that various other linkages are entirely feasible within the scope and principles of the invention, so long as they provide the requisite intermittent and alternate propelling forces on the platform arising from the cooperation of the wheels with the inner and outer tracks. Indeed, in an arrangement which I do not prefer, the wheels and their linkages need not be coupled directly to the rotating platform assembly, so long as they are arranged so as to impart rotational force to the rotating platform assembly.

It will be understood from the foregoing that although the invention has been described with respect to an exemplary embodiment thereof, as required by the statutes, various modifications and rearrangements, such as structural changes in the platform, base, seats, wheel locations, and linkage arrangements can be effected in the illustrated embodiment without departing from the principles, scope and spirit of the invention.

Having thus described an embodiment of my invention as required, I claim:

1. A rider propelled rotatable riding device comprising two similar, concentrically mounted, circular, vertically undulating tracks formed with peaks and valleys, the tracks being of different radii such that they are spaced from each other as inner and outer tracks, a rotatable rider supporting structure mounted for rotation concentrically with respect to said tracks, a pair of freely rotatable wheels coupled to said rider supporting structure and generally vertically movable for rolling along the undulating surfaces of respective ones of said tracks, the tracks and wheels being relatively disposed such that each wheel relative to its undulating track is out of phase with the other wheel relative to its undulating track, and rider controlled linkage means for selectively intermittently urging either wheel against its undulating track surface with increased force relative to the other wheel, whereby said supporting structure can be rotatably driven by selectively and alternately urging either wheel against a downhill portion of its undulating track relative to the force urging the other wheel against a non-downhill portion of the other undulating track.

2. Apparatus as claimed in claim 1 wherein said tracks are out of phase with each other such that the track peaks of each track are generally radially opposite the track valleys of the other track, and said wheels are generally radially disposed relative to each other such that the radially outer wheel will lie on a peak of the outer track when the radially inner wheel lies in a valley of the inner track.

3. Apparatus as claimed in claim 2 wherein said linkage means includes a shaft oriented in a generally radial plane, pivotally coupled at its midpoint to said rider support structure for pivotal movement vertically in said plane, and coupled to said wheels at its radially inner and outer ends, whereby said wheels are pivotally coupled together for substantially equal but opposite movement in a vertical radial plane as they roll along said vertically undulating tracks.

4. Apparatus as claimed in claim 3 wherein said rider support structure extends horizontally outwardly from its rotational axis, wherein said shaft is pivotally coupled beneath said support structure, and actuating links are coupled to said shaft on opposite sides of its pivot axis and extend upwardly through said support structure such that their upper ends are exposed for rider manipulation vertically.

5. Apparatus as claimed in claim 4 further comprising a rider support seat coupled to the upper ends of said actuating links such that a rider seated thereon can rock radially back and forth and shift his weight from one actuating link to the other so as to alternately relatively urge either link downwardly and decrease the relative downward force on the other link.

6. Apparatus as claimed in claim 5 wherein said support structure is a circular member above said tracks, and further comprising a plurality of said rider support seats and associated linkages, shafts and wheels equally spaced about the peripheral area of said support structure.

7. Apparatus as claimed in claim 2 comprising a generally radially oriented shaft pivotally coupled to said support structure for pivotal movement in a generally radial vertical plane and coupled with said wheels at its outer ends such that said wheels move generally vertically when said shaft pivots, the relative vertical heights of the undulations of the tracks and the location of the pivot axis of said shaft being such that said wheels bear substantially continuously on the undulating surfaces of the respective tracks and thus provide vertical support for the radially outer portion of the rider support structure.

8. Apparatus as claimed in claim 7 wherein said linkage means includes actuating links coupled to said shaft on opposite sides of its pivot axis and extending upwardly therefrom through said rider support structure so as to be vertically actuatable by a rider above the support structure.

9. Apparatus as claimed in claim 8 including a rider support seat coupled to the upper ends of said actuating links such that a rider seated thereon can shift his weight relatively from one actuating link to the other.

10. Apparatus as claimed in claim 9 wherein said wheels are freely rotatably mounted on horizontal axes carried by the lower ends of said actuating links, said shaft is pivotally coupled at its ends to the lower portions of said actuating links, and said rider support seat is pivotally coupled to the upper end portions of said actuating links.

11. Apparatus as claimed in claim 2 wherein said linkage means comprises a pivotal link located beneath and pivotally coupled intermediate its ends to said support structure for pivotal movement in a generally radial vertical plane, and actuating link means coupled to said pivotal link and extending upwardly through said support structure for urging alternate pivotal movement of said pivotal link under the control of a rider, said wheels being freely rotatably mounted at the lower end of the assembly of said pivotal link and said actuating link means so as to roll along said undulating tracks during rotation of said support structure.

12. Apparatus as claimed in claim 11 wherein said rider support structural is rotatably supported on a center post and extends outwardly over said tracks so as to support said wheels over said tracks.

* * * * *